US011110575B2

(12) United States Patent
Desch

(10) Patent No.: US 11,110,575 B2
(45) Date of Patent: Sep. 7, 2021

(54) COMBINATION NAIL DOWEL GUN

(71) Applicant: Gary Desch, Gig Harbor, WA (US)

(72) Inventor: Gary Desch, Gig Harbor, WA (US)

( * ) Notice: Subject to any disclaimer, the term of this patent is extended or adjusted under 35 U.S.C. 154(b) by 183 days.

(21) Appl. No.: 16/263,632

(22) Filed: Jan. 31, 2019

(65) Prior Publication Data

US 2020/0246950 A1 Aug. 6, 2020

(51) Int. Cl.
*B25C 1/00* (2006.01)
*B25C 1/04* (2006.01)

(52) U.S. Cl.
CPC ..... *B25C 1/043* (2013.01); *B25C 1/047* (2013.01)

(58) Field of Classification Search
CPC ..... B25C 1/047; B25C 1/18; B25C 1/182; B25C 1/184; B25C 1/00; B25C 1/001; B25C 1/003
USPC ..... 227/130
See application file for complete search history.

(56) References Cited

U.S. PATENT DOCUMENTS 3,386,639 A 6/1968 Unger
4,171,083 A * 10/1979 Lippacher ..... B25D 11/00 173/29
4,856,696 A 8/1989 Seld
5,143,572 A 9/1992 Hatch
5,524,808 A * 6/1996 Vogrig ..... F16B 5/04 227/147
5,558,264 A * 9/1996 Weinstein ..... B25C 1/08 227/10
5,579,975 A 12/1996 Moorman
6,079,604 A * 6/2000 Banducci ..... B21J 15/105 227/112
6,152,346 A * 11/2000 Laubach ..... B25C 1/003 227/109
6,318,617 B1 * 11/2001 Cheng ..... B25C 5/06 227/109
6,431,428 B1 8/2002 Chen
6,641,019 B2 * 11/2003 Hadfield ..... B25C 5/1641 227/109

(Continued)

FOREIGN PATENT DOCUMENTS

WO WO2017152740 9/2017

OTHER PUBLICATIONS

Lignoloc: The First Collated Nails Made of Wood; Material District; Oct. 10, 2017.*

(Continued)

*Primary Examiner* — Gloria R Weeks

(57) ABSTRACT

A combination nail dowel gun for efficient tilt up construction includes a hollow gun body comprising a handle portion and an upper portion. A pneumatic hammer is coupled within the gun body and has a barrel extending through a barrel aperture. A projectile feed belt is disposed within a canister, through a belt feed track, and into a muzzle of a projectile feeder. The projectile feed belt comprises a plurality of projectiles and a projectile alignment matrix. The plurality of projectiles is alternating dowels and nails and is coupled to the projectile alignment matrix. The plurality of projectiles is loaded into the barrel by the belt feed track and is then fired through the barrel by the pneumatic hammer. A trigger is coupled to the bottom side of the upper portion adjacent the handle portion. The trigger is in operational communication with the pneumatic hammer to fire the plurality of projectiles.

11 Claims, 4 Drawing Sheets

(56) References Cited

U.S. PATENT DOCUMENTS

| | | | | |
|---|---|---|---|---|
| 7,143,508 | B2 * | 12/2006 | Schnell | B25C 1/005 29/709 |
| 7,172,103 | B2 * | 2/2007 | Fujiyama | B25B 23/045 227/107 |
| D582,743 | S | 12/2008 | Buck | |
| 7,654,430 | B2 * | 2/2010 | Cho | B25C 5/1658 227/109 |
| 8,061,437 | B2 | 11/2011 | Liang | |
| 8,479,963 | B2 * | 7/2013 | Kitagawa | B25C 1/008 227/8 |
| 8,684,245 | B2 * | 4/2014 | Canlas, Jr. | B25C 1/005 227/120 |
| 8,998,056 | B2 * | 4/2015 | Huang | B25C 7/00 227/124 |
| 10,744,629 | B2 * | 8/2020 | Ishizawa | B25C 1/008 |
| 2004/0164117 | A1 * | 8/2004 | Nishikawa | B25C 1/08 227/10 |
| 2005/0263558 | A1 * | 12/2005 | Ishizawa | B25C 1/047 227/130 |
| 2007/0034659 | A1 * | 2/2007 | Moeller | B25C 1/08 227/8 |
| 2007/0075113 | A1 * | 4/2007 | Tillinghast | B25C 1/008 227/130 |
| 2012/0298712 | A1 * | 11/2012 | Ishizawa | B25C 1/008 227/8 |
| 2013/0020371 | A1 * | 1/2013 | Porth | B25C 1/08 227/8 |
| 2014/0034701 | A1 * | 2/2014 | Komazaki | B25C 1/047 227/8 |
| 2014/0158740 | A1 * | 6/2014 | Akutsu | B25C 1/046 227/130 |
| 2015/0197001 | A1 * | 7/2015 | Li | B25C 1/047 227/130 |
| 2017/0274512 | A1 * | 9/2017 | Ishizawa | B25C 1/04 |
| 2017/0297186 | A1 * | 10/2017 | Meyer | B25C 1/04 |

OTHER PUBLICATIONS

"Why in the World Would Anyone Want a Computer Driven Wooden Nail Gun" by Lloyd Alter, Nov. 25, 2019; Tree Hugger https://www.treehugger.com/why-world-would-anyone-want-computer-driven-wooden-nail-gun-4851998.*

"Lignoloc: The First Collated Nails made of Wood", Oct. 10, 2017; Material District https://materialdistrict.com/article/lignoloc-nails-wood/.*

* cited by examiner

COMBINATION NAIL DOWEL GUN

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to nail guns and more particularly pertains to a new nail gun for efficient tilt up construction.

BRIEF SUMMARY OF THE INVENTION

An embodiment of the disclosure meets the needs presented above by generally comprising a gun body comprising a handle portion and an upper portion. The upper portion has a top side, a bottom side, a back end, and a muzzle end. The gun body is hollow. The muzzle end has a barrel aperture extending therethrough. A pneumatic hammer is coupled within the gun body. The pneumatic hammer has a barrel extending through the barrel aperture. A projectile feeder is coupled to the gun body and comprises a canister, a belt feed track, and a muzzle. The muzzle is coupled to the muzzle end of the gun body around the barrel. The belt feed track is coupled to the muzzle and is in operational communication with the barrel. The cannister is coupled to the belt feed track. A projectile feed belt is disposed within the canister, through the belt feed track, and into the muzzle. The projectile feed belt comprises a plurality of projectiles and a projectile alignment matrix. The plurality of projectiles is alternating dowels and nails and is coupled to the projectile alignment matrix. The plurality of projectiles is loaded into the barrel by the belt feed track and is then fired through the barrel by the pneumatic hammer. A trigger is coupled to the bottom side of the upper portion adjacent the handle portion. The trigger is in operational communication with the pneumatic hammer to fire the plurality of projectiles.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
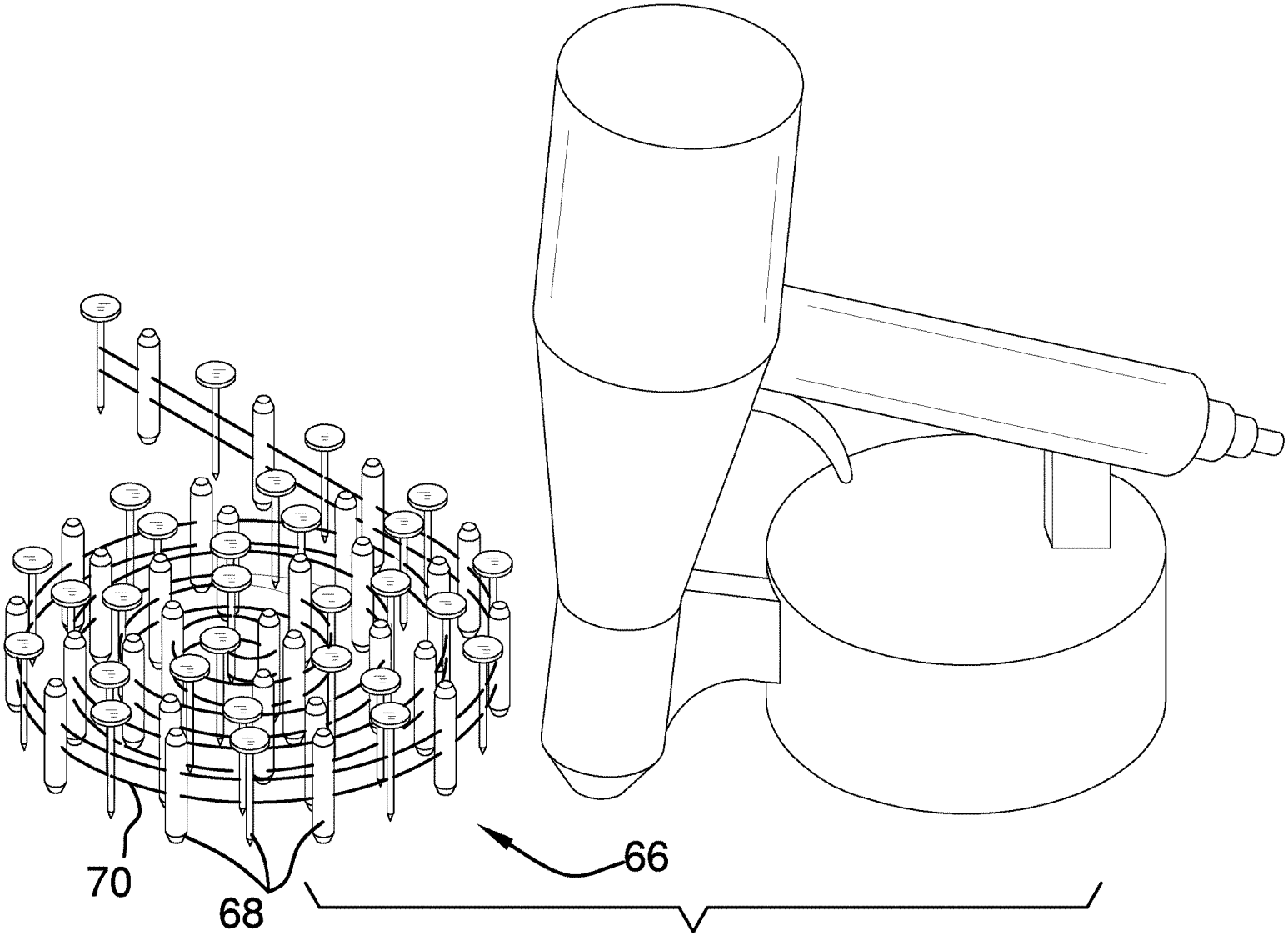
FIG. 1 is an isometric view of a combination nail dowel gun according to an embodiment of the disclosure.
Figure 2:
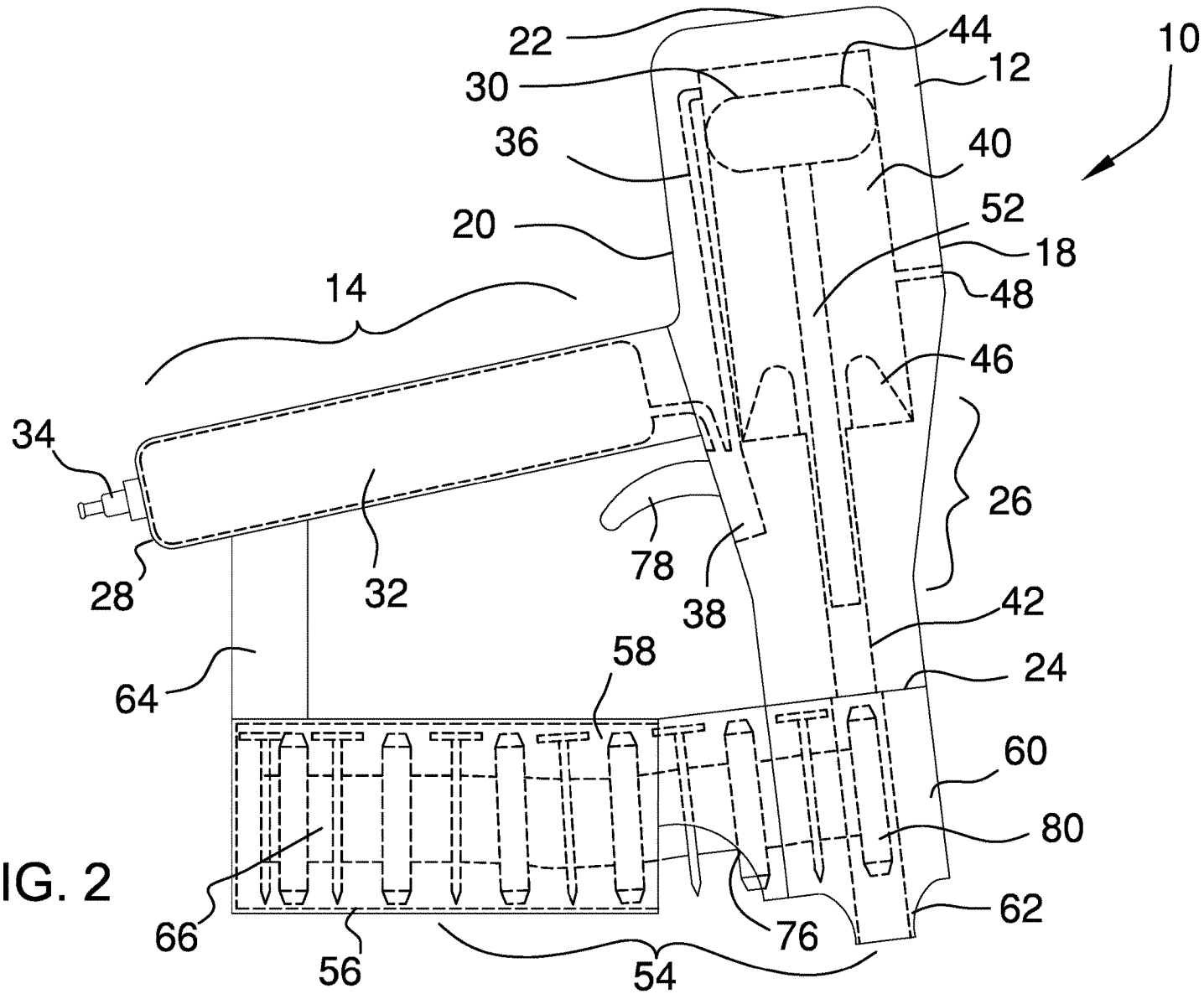
FIG. 2 is a side elevation view of an embodiment of the disclosure.
Figure 3:
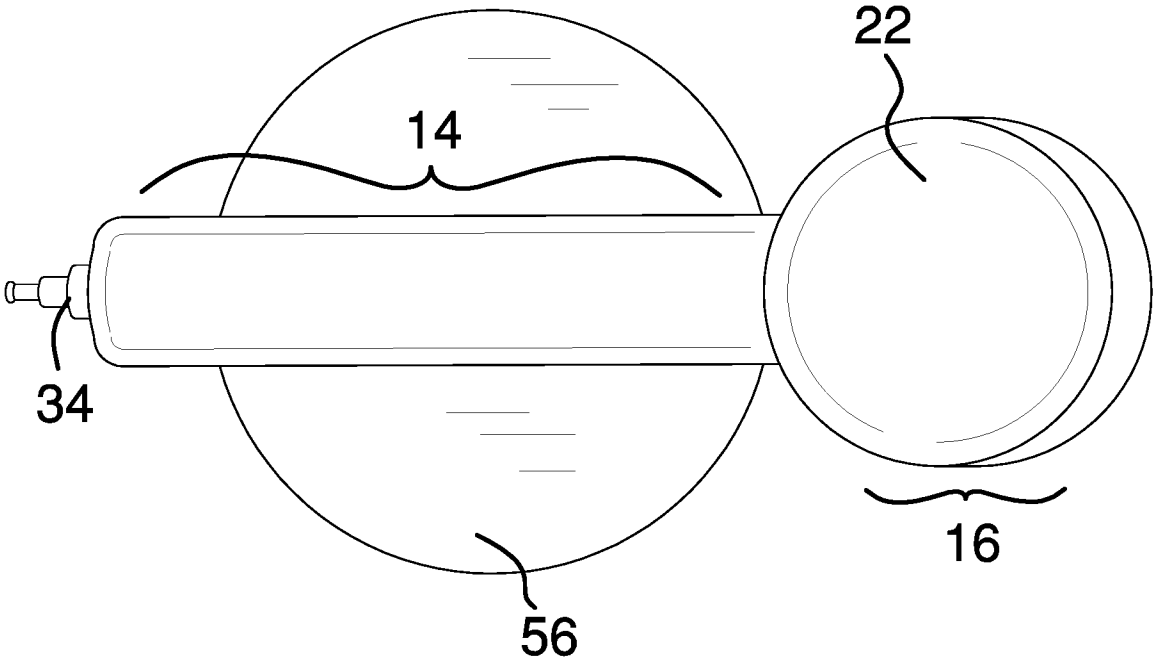
FIG. 3 is a rear elevation view of an embodiment of the disclosure.
Figure 4:
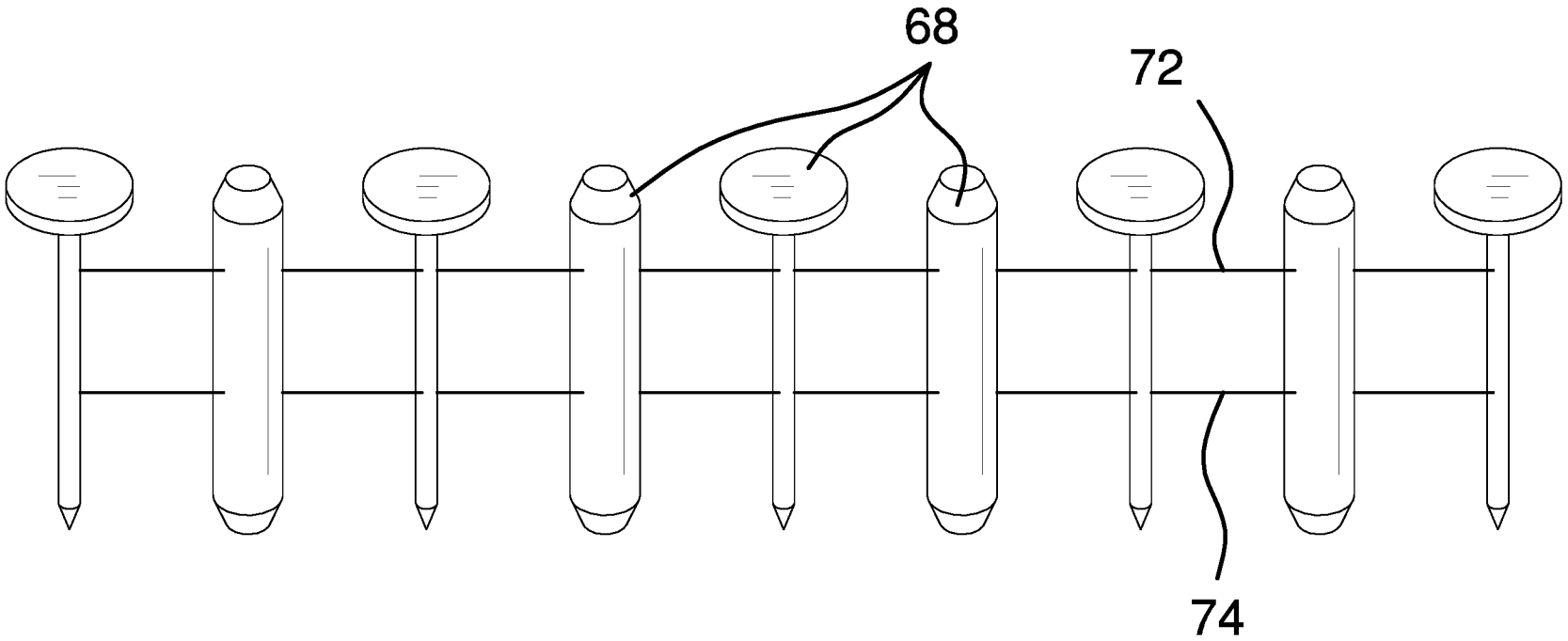
FIG. 4 is a detail view of an embodiment of the disclosure.

With reference now to the drawings, and in particular to FIGS. 1 through 4 thereof, a new nail gun embodying the principles and concepts of an embodiment of the disclosure and generally designated by the reference numeral 10 will be described.

As best illustrated in FIGS. 1 through 4, the combination nail dowel gun 10 generally comprises a gun body 12 comprising a handle portion 14 and an upper portion 16. The upper portion 16 has a top side 18, a bottom side 20, a back end 22, and a muzzle end 24. The upper portion 16 has a tapered section 26 between the back end 22 and the muzzle end 24. The handle portion 14 has a butt 28. The gun body 12 is hollow. The muzzle end 24 has a barrel aperture 28 extending therethrough.

A pneumatic hammer 30 is coupled within the gun body 12 and comprises an air reservoir 32, an air hose connection nipple 34, an air tube 36, a trigger valve 38, a cylinder 40, a barrel 42, a piston 44, and a bumper 46. The air reservoir 32 is coupled within the handle portion 14 and is configured to store high pressure air. The air hose connection nipple 34 is coupled to the butt 28 of the handle portion and is in operational communication with the air reservoir 32. The air hose connection nipple 34 is configured to receive a pump air hose. The air tube 36 extends from the air reservoir 32 into the upper portion 16 of the gun body proximal the back end 22. The trigger valve 38 is coupled to the air tube 36 and is configured to release a blast of the high pressure air from the air reservoir 32. The cylinder 40 is coupled to the air tube 36 within the upper portion 16 of the gun body and has an exhaust port 48 extending through the top side 18. The cylinder 40 is in operational communication with the air tube 36. The barrel 42 is coupled to the cylinder 40 and extends through the barrel aperture 28. The piston 44 is coupled within the cylinder 40 and comprises a head 50 and rod 52 coupled to the head 50. The rod 52 extends into the barrel 42. The bumper 46 is coupled within the cylinder adjacent the barrel 42.

A projectile feeder 54 comprises a canister 56, a belt feed track 58, and a muzzle 60. The muzzle 60 is coupled to the muzzle end 24 of the gun body around the barrel 42. The muzzle 60 may have an extension 62 that may be filleted. The belt feed track 58 is coupled to the muzzle 60 and is in operational communication with the barrel 42. The cannister 56 is coupled to the belt feed track 58. There may be a canister support 64 extending between the canister 56 and the handle portion 14 for structural integrity. A projectile feed belt 66 is disposed within the canister 56, through the belt feed track 58, and into the muzzle 60. The projectile feed belt 66 comprises a plurality of projectiles 68 and a projectile alignment matrix 70. The plurality of projectiles 68 is alternating dowels and nails. The plurality of projectiles 68 is coupled to the projectile alignment matrix 70, which may comprise an upper guidewire 72 and a lower guidewire 74. The plurality of projectiles 68 is loaded into the barrel 42 by the belt feed track 58. The belt feed track 58 may have a cutout 76 exposing the projectile feed belt 66 passing therethrough. The cutout 76 may be rounded. A trigger 78 is coupled to the bottom side 20 of the upper portion adjacent the handle portion 14. The trigger 78 is in operational communication with the pneumatic hammer 30 to fire the plurality of projectiles 68.

In use, the trigger 78 is pulled to activate the trigger valve 38 to release a blast of high pressure air, forcing the head 50 of the piston to drive the rod 52 through the barrel 42 to fire a topmost projectile 80 of the plurality of projectiles. The combination nail dowel gun 10 serves in tilt up construction in which workers alternate between driving nails and dowels, with the plurality of projectiles 68 alternating to prevent the need to switch between tools.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A combination nail dowel gun comprising:

a gun body, the gun body comprising a handle portion and an upper portion, the upper portion having a top side, a bottom side, a back end, and a muzzle end, the gun body being hollow, the muzzle end having a barrel aperture extending therethrough;

a pneumatic hammer coupled to the gun body, the pneumatic hammer being coupled within the gun body, the pneumatic hammer having a barrel extending through the barrel aperture;

a projectile feeder coupled to the gun body, the projectile feeder comprising a canister, a belt feed track, and a muzzle, the muzzle being coupled to the muzzle end of the gun body around the barrel, the belt feed track being coupled to the muzzle and in operational communication with the barrel, and the canister being coupled to the belt feed track;

a projectile feed belt, the projectile feed belt being disposed within the canister, through the belt teed track, and into the muzzle, the projectile feed belt comprising a plurality of projectiles and a projectile alignment matrix, the plurality of projectiles being alternating dowels and nails, the plurality of projectiles being coupled to the projectile alignment matrix, the plurality of projectiles being loaded into the barrel by the belt feed track, the plurality of projectiles being fired through the barrel by the pneumatic hammer; and a trigger coupled to the gun body, the trigger being coupled to the bottom side of the upper portion adjacent the handle portion, the trigger being in operational communication with the pneumatic hammer to fire the plurality of projectiles.

2. The combination nail dowel gun of claim 1 further comprising the pneumatic hammer further comprising:

an air reservoir coupled to the gun body, the air reservoir being coupled within the handle portion, the air reservoir being configured to store high pressure air;

an air hose connection nipple coupled to the gun body, the air hose connection nipple being in operational communication with the air reservoir, the air hose connection nipple being configured to receive a pump air hose;

an air tube coupled to the air reservoir, the air tube extending into the upper portion of the gun body proximal the back end;

a trigger valve coupled to the air tube, the trigger valve being in operational communication with the trigger;

a cylinder coupled to the gun body, the cylinder being coupled within the upper portion, the cylinder having an exhaust port extending through the top side, the cylinder being in operational communication with the air tube, the cylinder being coupled to the barrel;

a piston coupled within the cylinder, the piston comprising a head and rod coupled to the head, the rod extending into the barrel; and a bumper coupled to the cylinder, the bumper being coupled adjacent the barrel.

3. The combination nail dowel gun of claim 2 further comprising the air hose connection nipple being coupled to a butt of the handle portion of the gun body.

4. The combination nail dowel gun of claim 1 further comprising a canister support coupled to the projectile feed mechanism and the gun body, the canister support extending between the canister and the handle portion.

5. The combination nail dowel gun of claim 1 further comprising the muzzle having an extension.

6. The combination nail dowel gun of claim 5 further comprising the extension being filleted.

7. The combination nail dowel gun of claim 1 further comprising the belt feed track having a cutout, the cutout exposing the projectile feed belt passing therethrough.

8. The combination nail dowel gun of claim 7 further comprising the cutout being rounded.

9. The combination nail dowel gun of claim 1 further comprising the upper portion of the gun body having a tapered section between the back end and the muzzle end.

10. The combination nail dowel gun of claim 1 further comprising the projectile alignment matrix comprising an upper guidewire and a lower guidewire.

11. A combination nail dowel gun comprising:

a gun body, the gun body comprising a handle portion and an upper portion, the upper portion having a top side, a bottom side, a back end, and a muzzle end, the upper portion having a tapered section between the back end and the muzzle end, the handle portion having a butt, the gun body being hollow, the muzzle end having a barrel aperture extending therethrough;

a pneumatic hammer coupled to the gun body, the pneumatic hammer being coupled within the gun body, the pneumatic hammer further comprising:

an air reservoir coupled to the gun body, the air reservoir being coupled within the handle portion, the air reservoir being configured to store high pressure air;

an air hose connection nipple coupled to the gun body, the air hose connection nipple being coupled to the butt of the handle portion, the air hose connection nipple being in operational communication with the air reservoir, the air hose connection nipple being configured to receive a pump air hose;

an air tube coupled to the air reservoir, the air tube extending into the upper portion of the gun body proximal the back end;

a trigger valve coupled to the air tube, the trigger valve being configured to release a blast of the high pressure air from the air reservoir;

a cylinder coupled to the gun body, the cylinder being coupled within the upper portion, the cylinder having an exhaust port extending through the top side, the cylinder being in operational communication with the air tube;

a barrel coupled to the cylinder, the barrel extending through the barrel aperture;

a piston coupled within the cylinder, the piston comprising a head and rod coupled to the head, the rod extending into the barrel; and a bumper coupled to the cylinder, the bumper being coupled adjacent the barrel;

a projectile feeder coupled to the gun body, the projectile feeder comprising a canister, a belt feed track, and a muzzle, the muzzle being coupled to the muzzle end of the gun body around the barrel, the muzzle having an extension, the extension being filleted, the belt feed track being coupled to the muzzle and in operational communication with the barrel, and the cannister being coupled to the belt feed track, the belt feed track having a cutout, the cutout exposing the projectile feed belt passing therethrough, the cutout being rounded;

a canister support coupled to the projectile feed mechanism and the gun body, the canister support extending between the canister and the handle portion;

a projectile feed belt, the projectile feed belt being disposed within the canister, through the belt feed track, and into the muzzle, the projectile feed belt comprising a plurality of projectiles and a projectile alignment matrix, the plurality of projectiles being alternating dowels and nails, the plurality of projectiles being coupled to the projectile alignment matrix, the projectile alignment matrix comprising an upper guidewire and a lower guidewire, the plurality of projectiles being loaded into the barrel by the belt feed track, the plurality of projectiles being fired through the barrel by the pneumatic hammer; and a trigger coupled to the gun body, the trigger being coupled to the bottom side of the upper portion adjacent the handle portion, the trigger being in operational communication with the pneumatic hammer to fire the plurality of projectiles.

* * * * *